US007374144B1

(12) United States Patent
Wonderling

(10) Patent No.: US 7,374,144 B1
(45) Date of Patent: May 20, 2008

(54) FOLDING PORTABLE EASEL

(76) Inventor: James B. Wonderling, P.O. Box 474, Horseheads, NY (US) 14845

( * ) Notice: Subject to any disclaimer, the term of this patent is extended or adjusted under 35 U.S.C. 154(b) by 0 days.

(21) Appl. No.: 11/508,676

(22) Filed: Aug. 23, 2006

(51) Int. Cl.
*A47B 97/04* (2006.01)

(52) U.S. Cl. ..... 248/460; 248/441.1; 248/462; 248/463

(58) Field of Classification Search ..... 248/460, 248/462, 463, 464, 465, 441.1
See application file for complete search history.

(56) References Cited

U.S. PATENT DOCUMENTS

| | | | | |
|---|---|---|---|---|
| 404,146 | A | 5/1889 | Ackerman | |
| 1,625,904 | A | 4/1927 | Mattson | |
| 2,019,214 | A * | 10/1935 | Denny | 248/449 |
| 3,368,786 | A * | 2/1968 | Bulman | 248/455 |
| 3,799,488 | A | 3/1974 | Sena | |
| 4,042,203 | A | 8/1977 | Warkentin | |
| 4,609,174 | A | 9/1986 | Nakatani | |
| 6,202,974 | B1 | 3/2001 | Rellinger | |
| 6,338,216 | B1 | 1/2002 | Young | |

* cited by examiner

*Primary Examiner*—Amy J. Sterling
(74) *Attorney, Agent, or Firm*—McHale & Slavin, P.A.

(57) ABSTRACT

The purpose of this invention is to provide an easel assembly reversibly transformable between a deployed position suitable for supporting at least one planar item thereon and a collapsed position suitable for transport and storage. The easel assembly includes a pair of support members. Each support member is pivotally interconnected for selective movement between a folded position where said support members are generally parallel and a deployed position where said support members divaricate. In addition, each support member is integrally connected to a base member which is constructed and arranged for removable, pivotal interconnection at the end opposite the support member. The connected base members are constructed and arranged for positioning on a planar surface when the easel assembly is in the deployed position, thereby distributing any downward load of the easel assembly along the planar surface to resist tipping and maintain the stability of the deployed easel. The support members also include an upper and lower portion which are connected together in a manner that allows the easel assembly to attain a collapsed state suitable for transport and storage.

5 Claims, 13 Drawing Sheets

FOLDING PORTABLE EASEL

FIELD OF THE INVENTION

The invention generally relates to a portable easel; particularly, to a folding easel transformable between a deployed position suitable for supporting at least one planar item thereon and a collapsed position for easy transport and storage.

BACKGROUND OF THE INVENTION

Easels have been used since ancient times for the purpose of supporting planar items, such as, posters, artwork, and the like. They may be used to hold up a painter's canvas or sketchbook while the artist is working on it or to display a completed painting for exhibition. The simplest form of an artist's easel consists of three vertical support members joined at one end. A pivoting mechanism allows the centermost support member to pivot away from the other two, forming a tripod. The two non-pivoting support members have a horizontal cross-member on which the planar item is placed.

Easels can be divided into two general categories; large, full-size easels designed for permanent studio use, and folding, lightweight easels for travel. Permanent easels have been primarily designed as stationary display furniture and are capable of exhibiting large and/or smaller pieces of finished art. Whereas, portable easels often include telescopic or folding legs that collapse for ease of transport and storage. While portable, folding easels work well for holding lighter items (smaller canvasses), they are not always stable enough for larger and/or heavier items.

For example, the three supports of the tripod-type portable easel must be interconnected by a plurality of horizontal bracing members (crossbars) at an intermediate point to prevent the support members from spreading apart and collapsing when a large/heavy item is placed thereon. The addition of these horizontal members often results in an easel assembly that is complex (composed of multiple parts) and therefore, expensive to manufacture, and difficult to assemble. Moreover, most lightweight, portable easels can easily become top-heavy and tip over when larger items are placed thereon.

As a consequence of these aforementioned problems, it is an object of the present invention to provide a portable easel assembly of a simple and elegant design comprising few individual parts while providing superior stability with no cross-bracing required. In addition, the easel of the present invention is capable of being easily transported and stored when in its collapsed state.

DESCRIPTION OF THE PRIOR ART

The prior art discloses numerous easel assemblies which are designed for enhanced stability and portability. For example, U.S. Pat. No. 404,146 to Ackerman, discloses a foldable easel with elongated supports members A, A and F that have foot members D, D attached to the bottom thereof. This construction permits assembly and disassembly by collapsing and folding the support and foot members into the configuration shown in FIGS. 2 and 3. However, unlike the present invention, the support members are of a unitary construction, and thus are not connected together in a manner that allows the easel to attain a size suitable for transport and storage. Moreover, the '146 easel requires an additional back support member F to provide the necessary stability to the assembled easel.

Similarly, U.S. Pat. No. 1,625,904 to Mattson, is drawn to a folding easel forming a general pyramid-shape construction. The easel can be folded up flat for ease in transporting, as shown in FIG. 2. Unlike the present invention, this patent fails to disclose support members formed from two separate portions which are connected together in a manner that allows the easel to attain a collapsed state suitable for transport and storage.

U.S. Pat. No. 3,799,488, to Sena, is directed to an artist's collapsible easel which can be mounted either on a table or upon a wall and wherein the frames of the same can be angled and rigidly held in the angled positions against collapse upon one another by slide plates having lateral projections that can adjustably engage between the side edges of the frames close to the point of the pivot bolt connection between the frames. An U-shaped base and canvas supporting frames and brackets for engagement with the upper and lower edges of the artist's canvas frame are connected in an adjustable manner upon the legs of the canvas supporting frame. The free ends of the frame legs are joined together by the pivot bolt connections and held against collapse by the lateral projections of slide plates held in common with leg ends and the same pivot bolts.

U.S. Pat. No. 4,042,203 to Warkentin, discloses a folding artist's easel which utilizes square steel tubing to form a rigid triangular base, a supporting column, and a telescopic brace, with pivotal connections therebetween. A workpiece is clamped to the easel by means of individually adjustable upper and lower steel cross-members which permit adjustment in the elevation of the workpiece as well as clamping a workpiece of great height. When the easel is folded, either (or both) the brace or the lower cross-member may be secured in place to retain the easel in its folded position, and the pivotal connection between the base and the brace interlocks with the column to prevent side movement between these parts.

U.S. Pat. No. 6,202,974, to Rellinger, describes a tripod-type portable easel with adjustable board support which has a plurality of legs pivotally joined together by a head, the legs of which may be selectively spread apart when set up as an easel and folded together when collapsed. Each leg is composed of multiple interlocked sections biased together when in their extended position which may be manipulated for separation and folding into a bundle, one section against another section for storage and transport, and a board support mounted on at least one leg which may be selectively adjustably moved to a desired position on any of the sections and moved against the leg on which it is mounted for storage and transport and extended away from the leg for holding a display on the easel when set up. This patent fails to teach base members that distribute the downward force of the load onto the planar surface (e.g., floor) thereby providing stability to the easel in the extended position.

U.S. Pat. No. 6,338,216, to Young, discloses an artist and display easel that is secured from the top by use of a crossbar that interlocks with the easel to hold a standard canvas or display. The top crossbar holds the easel body in place by interlocking notches. The top crossbar also holds the top of a display or canvas securely to the easel body. Unlike the present invention, this patent requires the use of a crossbar for stability. Furthermore, it fails to disclose base members formed of two separate portions connected together in a manner that allows the easel to attain a collapsed state suitable for transport and storage.

In contrast to the instant invention, the foregoing described prior art fails to teach or suggest an elegant easel that is sufficiently stable to support large works in its deployed state, yet capable of being easily transported and stored in its collapsed state.

SUMMARY OF THE INVENTION

The instant invention is directed toward an easel assembly reversibly transformable between a deployed position suitable for supporting at least one planar item thereon and a collapsed position suitable for transport and storage. Examples of some non-limiting planar items include canvasses, posters, or the like. The easel assembly includes a pair of corresponding support members wherein each support member is pivotally interconnected at the upper portion for selective movement between a folded position where the support members are generally parallel and a deployed position where the support members divaricate.

Each of the support members is composed of an upper portion and a lower portion, wherein the lower portion of each of the support members is integrally connected to a base member. The base members are constructed and arranged for removable attachment together at the end opposite the support member. The connected base members are constructed and arranged for positioning on a planar surface (e.g., floor, table, etc) when the easel is in its deployed position, thereby distributing the downward load of the at least one planar item and/or easel assembly along the planar surface. The distribution of downward force along the base members results in a deployed easel assembly resistant to tipping. The upper and lower portions are connected together in a manner that allows the easel to attain a collapsed state suitable for easy transport and storage.

Accordingly, it is an objective of the instant invention to provide an easel assembly that may be reversibly transformable between a deployed position and a collapsed position using little to no tools (e.g., screwdriver), and which of a stable and robust design, while remaining aesthetically pleasing.

Still another objective of the present invention is to teach an easel that is economical to manufacture in that it has few components or complicated moving parts.

It is yet another objective of the instant invention to provide an easel capable of holding at least one planar item thereon.

Another objective of the present invention is to teach an easel composed of commercially available parts resulting in an easel economical to manufacture, ship, and easy to assemble.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof. It will be readily appreciated by those skilled in the art that the use of an easel for supporting planar items thereon for the purpose of providing a work surface or a display is useful in the art.

DETAILED DESCRIPTION OF THE INVENTION

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 1:
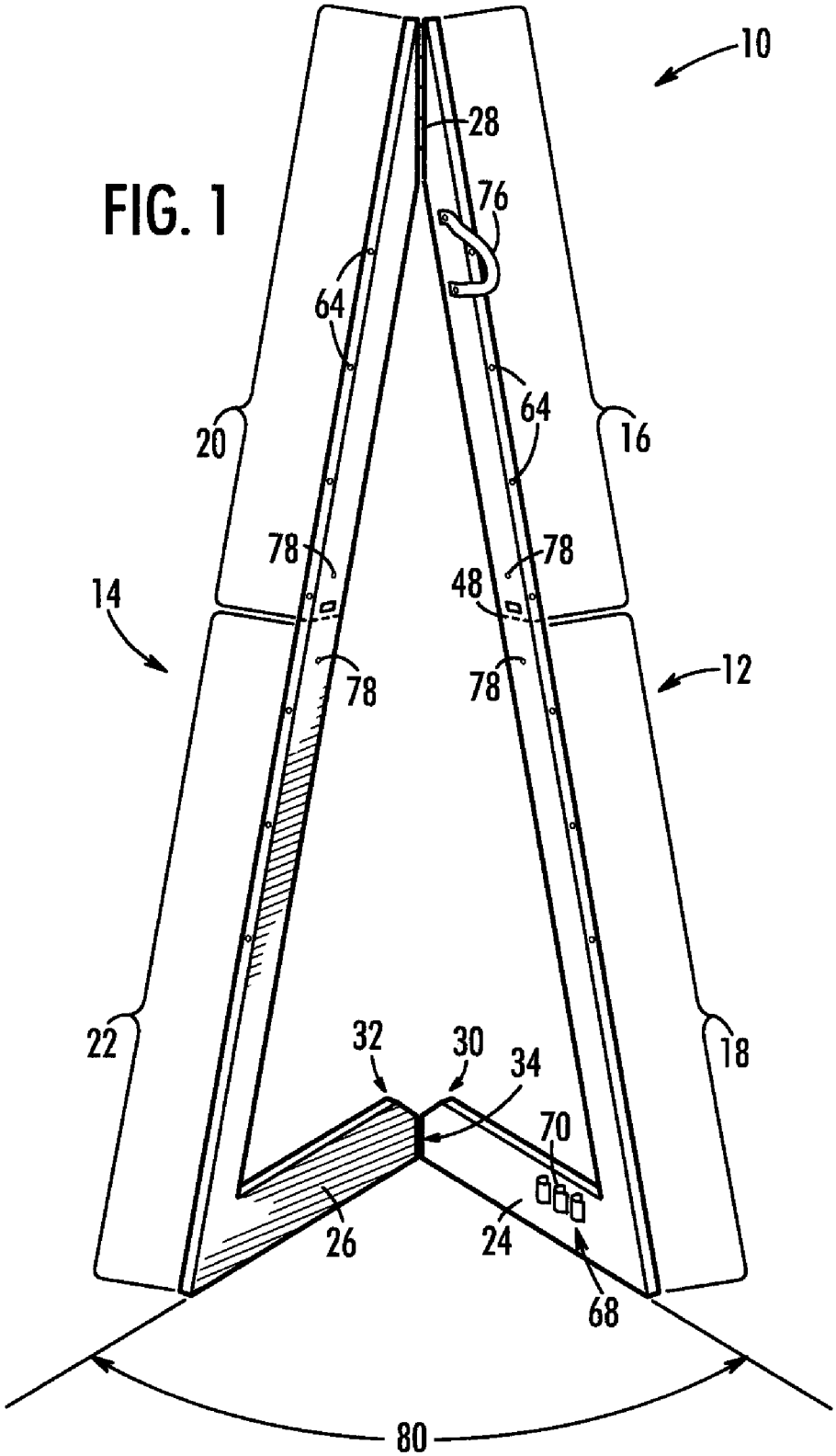
FIG. 1 is an upper perspective view of the easel assembly according to one embodiment of the present invention, as seen from the front in the upright and deployed position.
Figure 2:
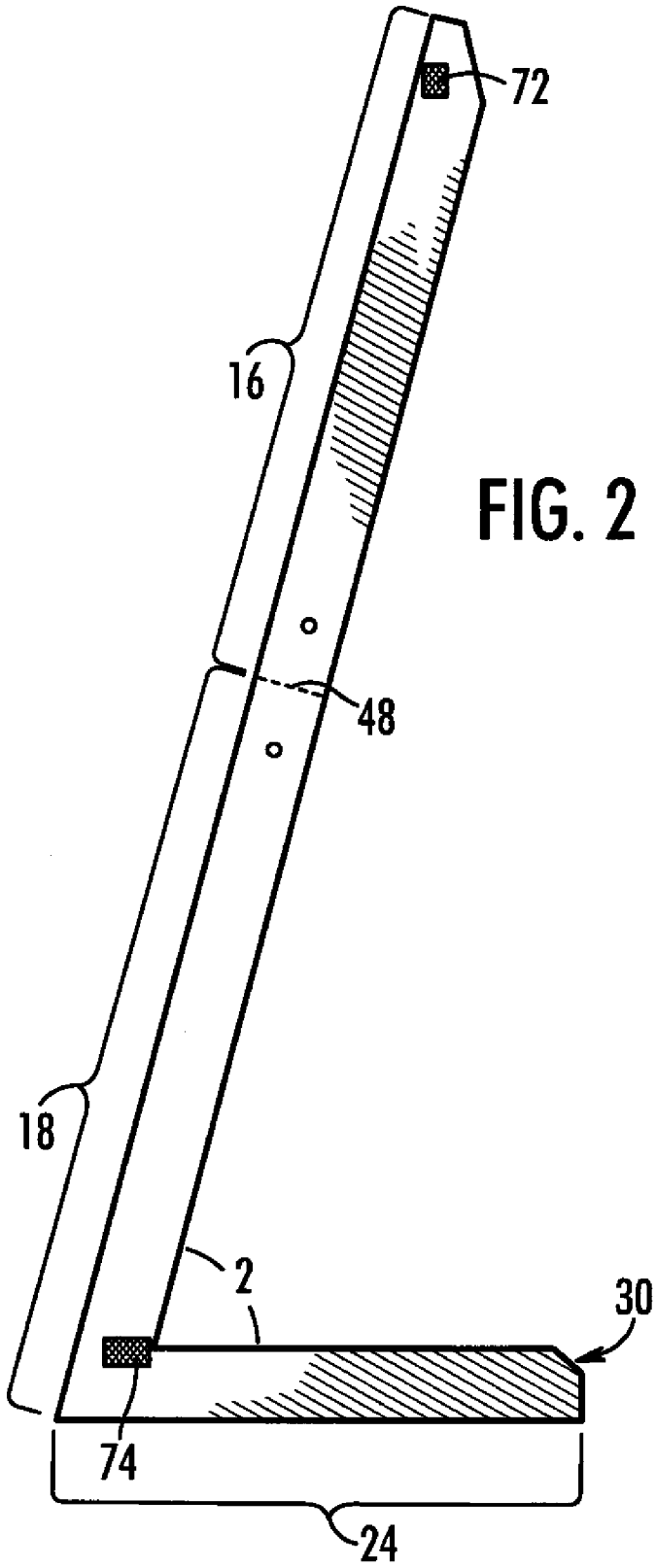
FIG. 2 is a side view of the easel assembly shown in FIG. 1.
Figure 3:
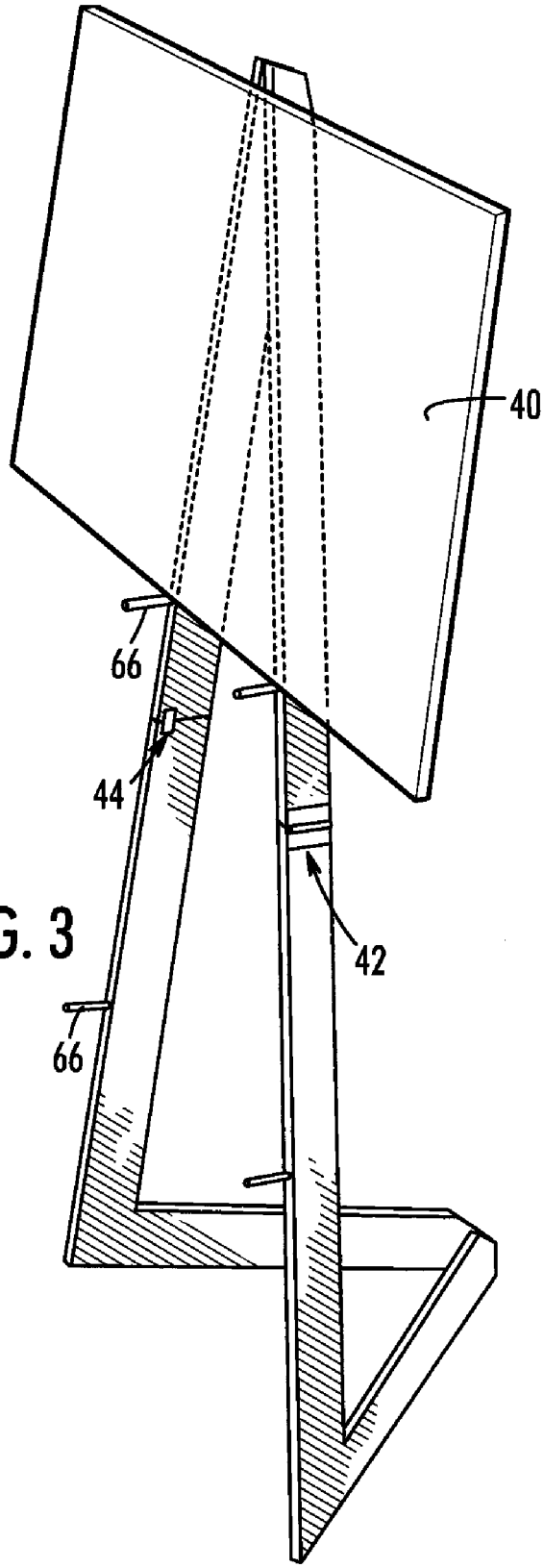
FIG. 3 is a side perspective view of the easel assembly of FIG. 1 supporting a planar item thereon.
Figure 5:
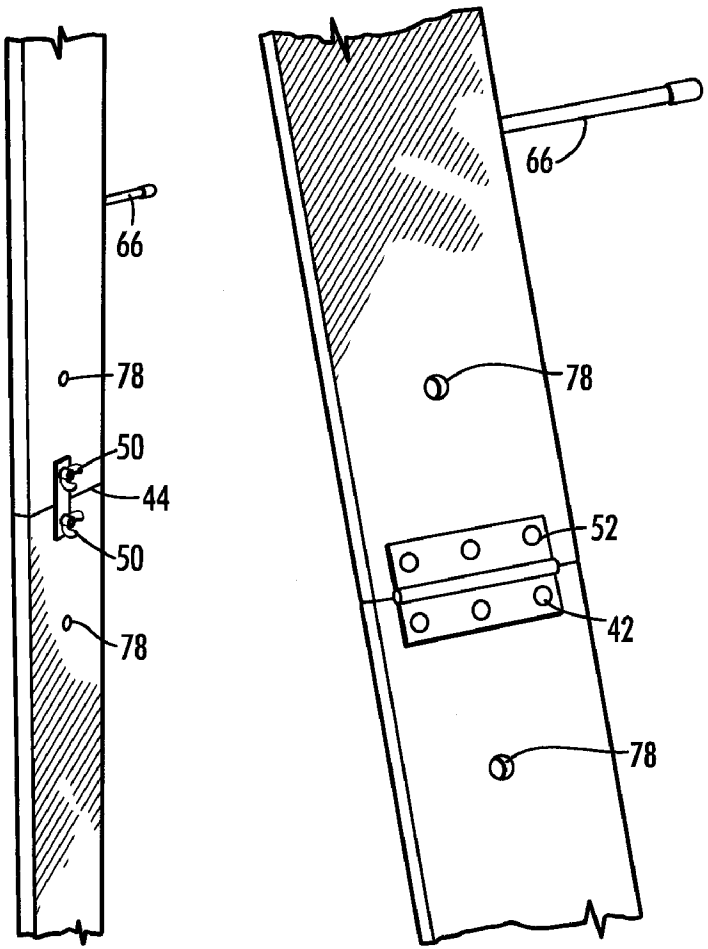
FIG. 5 is a partial back view of the easel assembly showing the upper and lower portions of the support members pivotally attached by another hinge.
Figure 4:
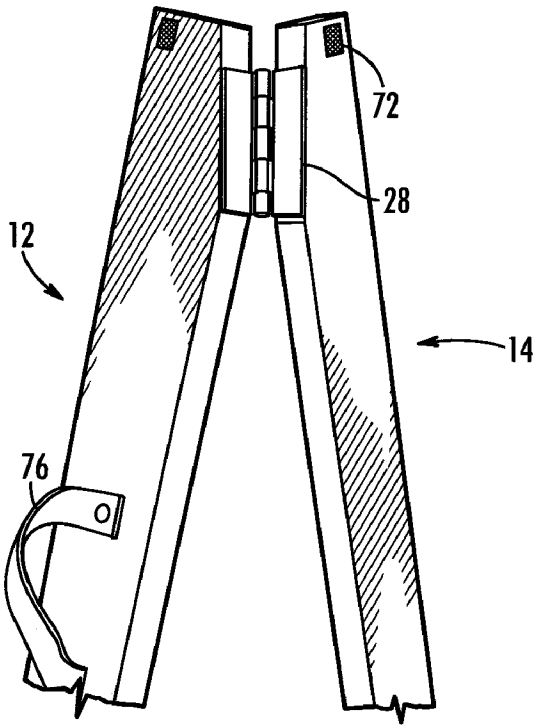
FIG. 4 is a partial upper back view of the easel assembly showing the upper portions attached by a hinge.
Figure 6:
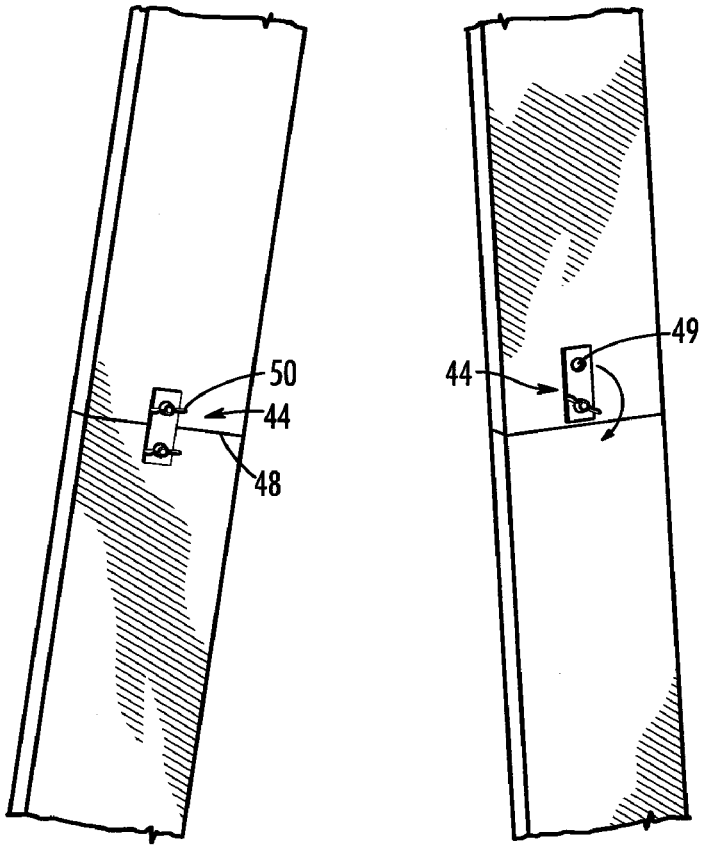
FIG. 6 is a partial front view of the easel assembly showing the upper and lower portions of the support members provided with additional support by a securing means.

Referring now to FIGS. 1-15, wherein like elements are numbered consistently throughout, FIG. 1 illustrates one embodiment of the easel assembly according to the present invention, generally referenced herein as 10. FIGS. 1 and 3 show the easel assembly in a deployed position capable of supporting at least one planar item 40 thereon. As shown in FIGS. 1-15, the easel assembly includes a pair of substantially identical support members, shown here as "L-shaped" right and left support members 12, 14.

Each support member comprises an upper portion 16, 20 and a lower portion 18, 22. The upper portion of both support members is pivotally interconnected by any suitable pivot means known in the art, for example, a hinge 28 (see FIG. 4). The pivot means allows the easel to be disposed between a folded position where the support members are generally parallel (see FIGS. 10-12) and a deployed "pyramidal" position where the support members diverge, as shown in FIGS. 1 and 3. The lower portion of each of the support members are integrally connected to a base member 24, 26 (right and left, respectively). The support members and base members allow the easel assembly to stand upright without the need for any additional cross-brace or back support member, thereby providing a stable and aesthetically pleasing design.

Figure 7:
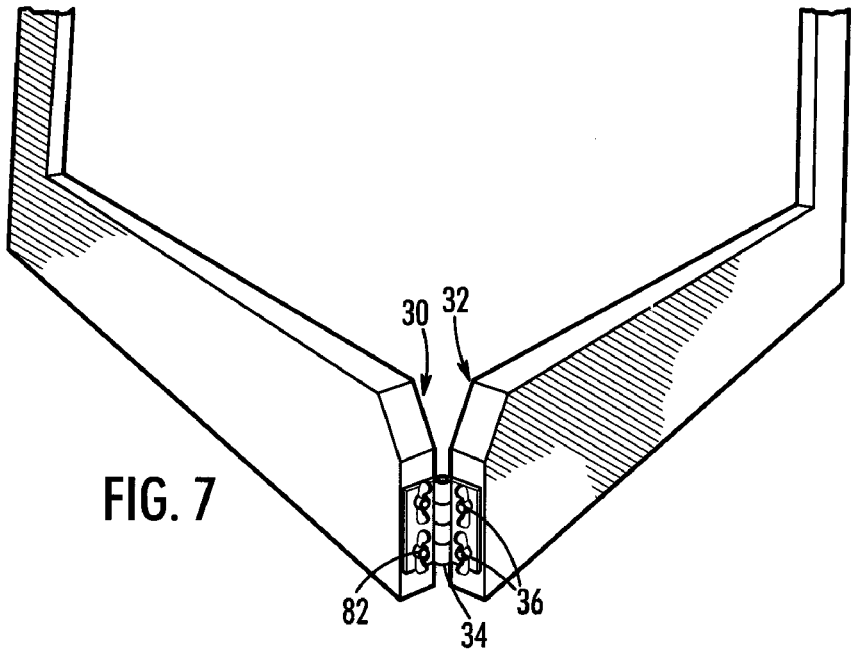
FIG. 7 is a partial back view of the easel assembly showing the base members pivotally attached by a removable hinge.
Figure 8:
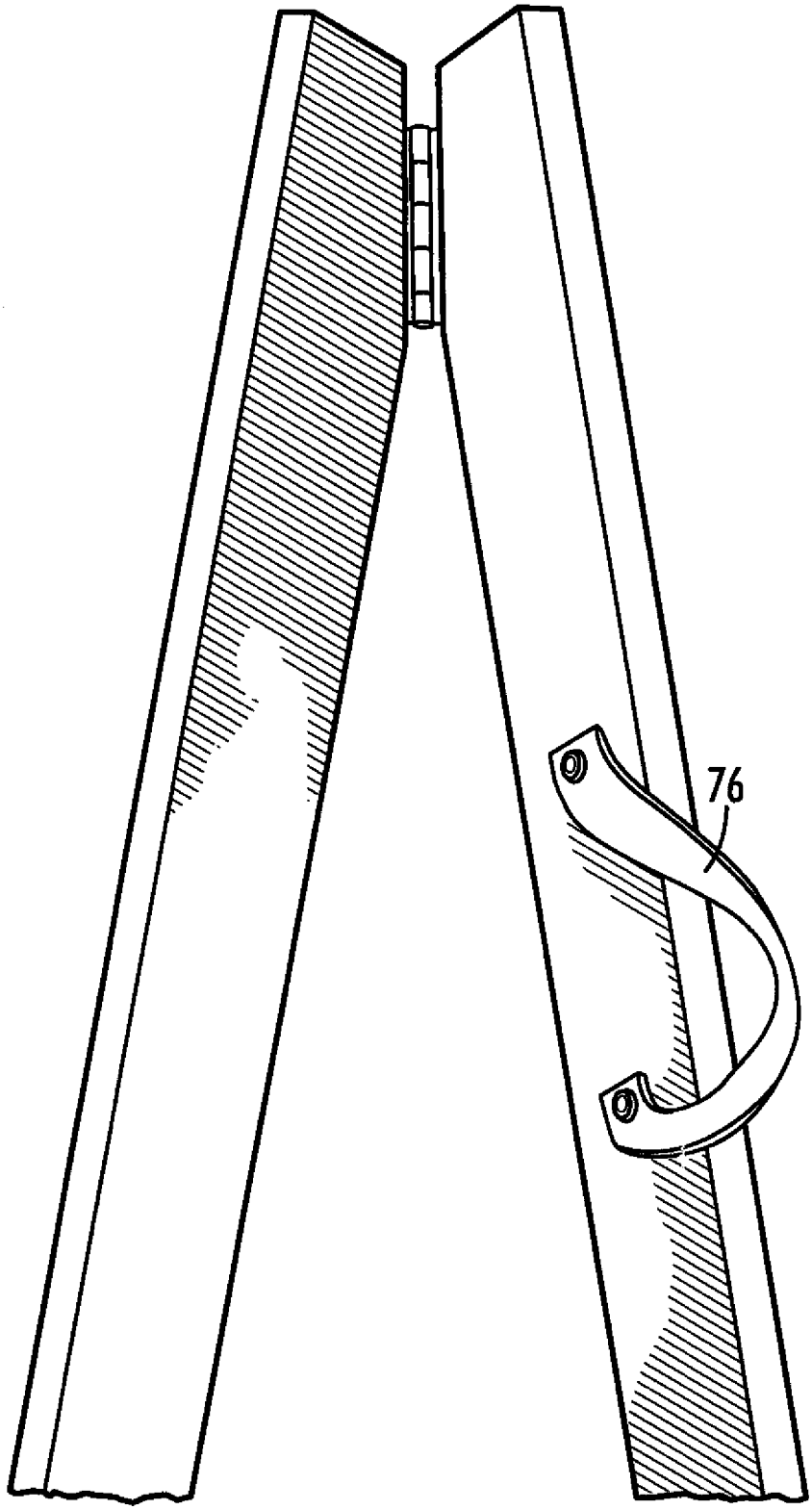
FIG. 8 is a partial front view of the easel showing the upper portions with an attached handle.
Figure 9:
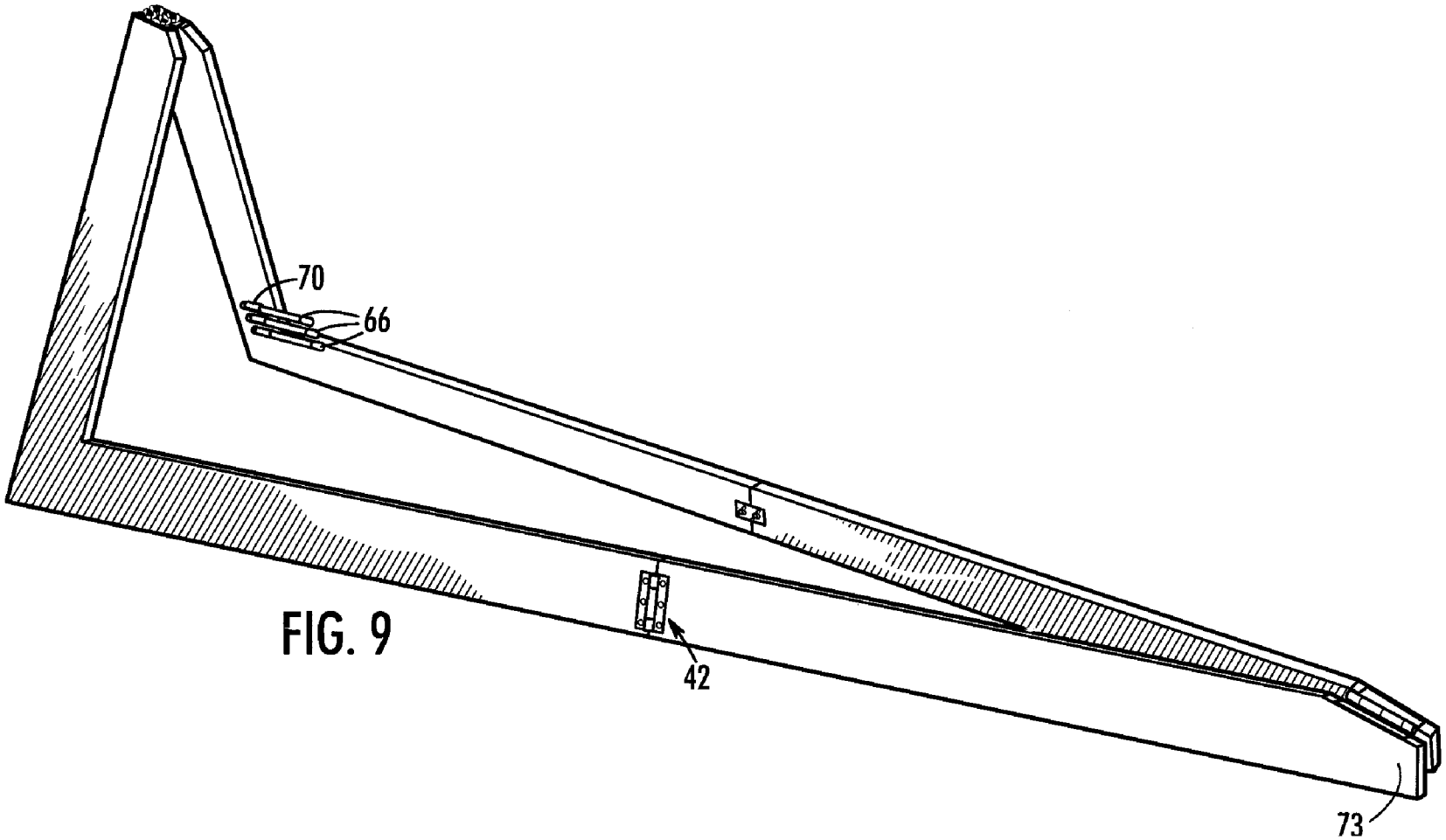
FIG. 9 is an upper perspective view of the easel assembly disposed on a planar surface.
Figure 10:
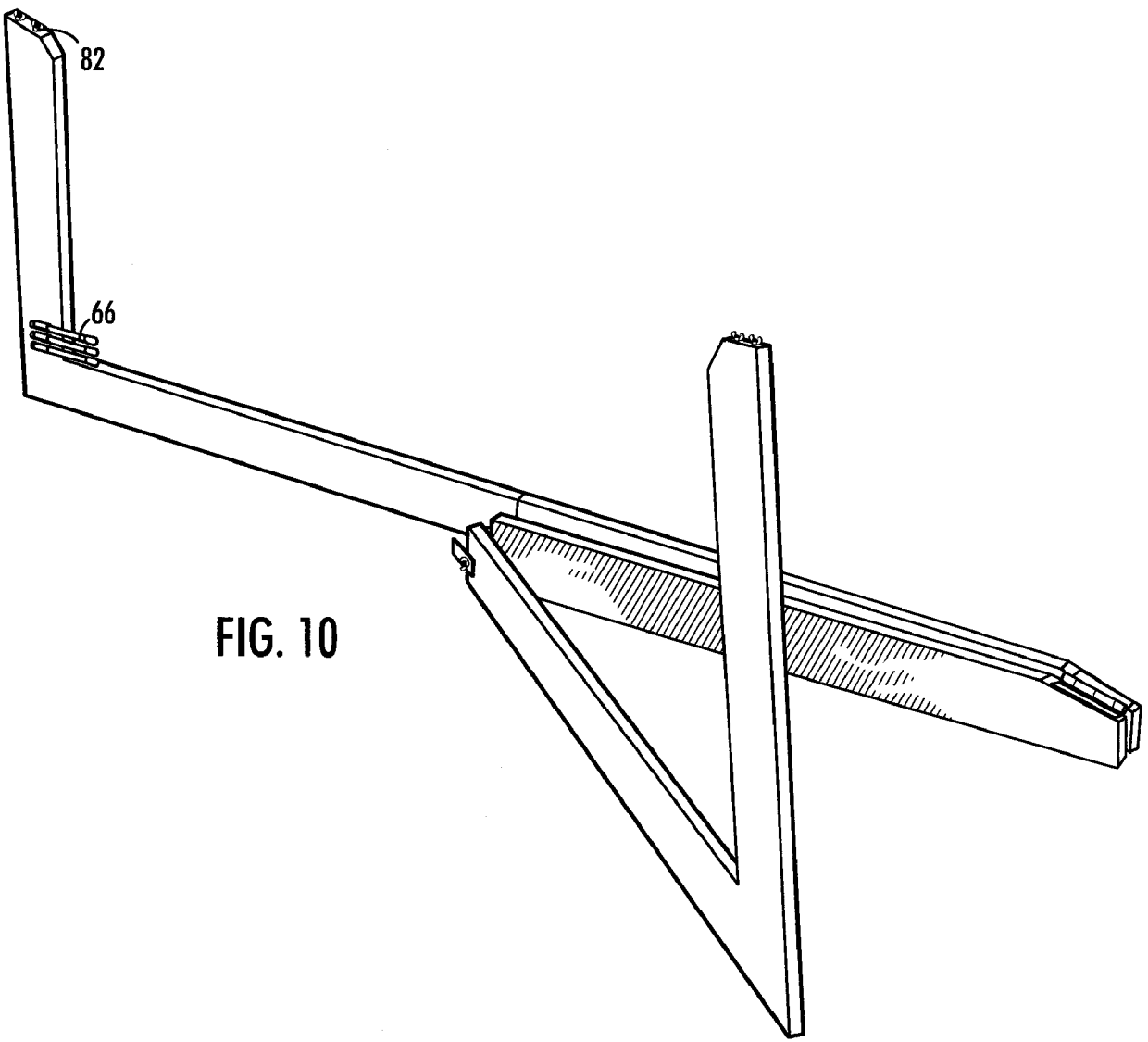
FIG. 10 is an upper perspective of the easel assembly showing one lower portion of the support member being pivoted along the hinge shown in FIG. 5.

Each base member is constructed and arranged for removable attachment together at the ends opposite 30, 32 the support member 12, 14. The base members may be removably and pivotally interconnected by any means deemed suitable. For example, as shown in FIG. 7, the base members are connected together by a removable hinge assembly 34. The base members include at least one integrally attached threaded post 82 (two are shown in FIG. 10) capable of receiving any conventional hinge assembly. Thus, one side of the hinge is connected/disconnected from the posts by wing nuts 36 which can be tightened/loosened by hand without the need for additional tools (e.g., screwdriver). The connected base members can then be positioned onto a planar surface (e.g., floor, table, etc) and the support members separated (FIG. 1). As shown in FIG. 2, the base members are formed at an acute angle $\alpha$ relative to the support member. Preferably, the angle $\alpha$ is between about 50° and about 70°. The angled configuration acts to distribute the downward load (weight) of the planar item and/or easel assembly along the planar surface to lower the center of gravity. The lowered center of gravity makes the easel more resistant to tipping and acts to maintain the stability of the easel when deployed, as compared to the aforementioned prior art easel assemblies.

Figure 11:
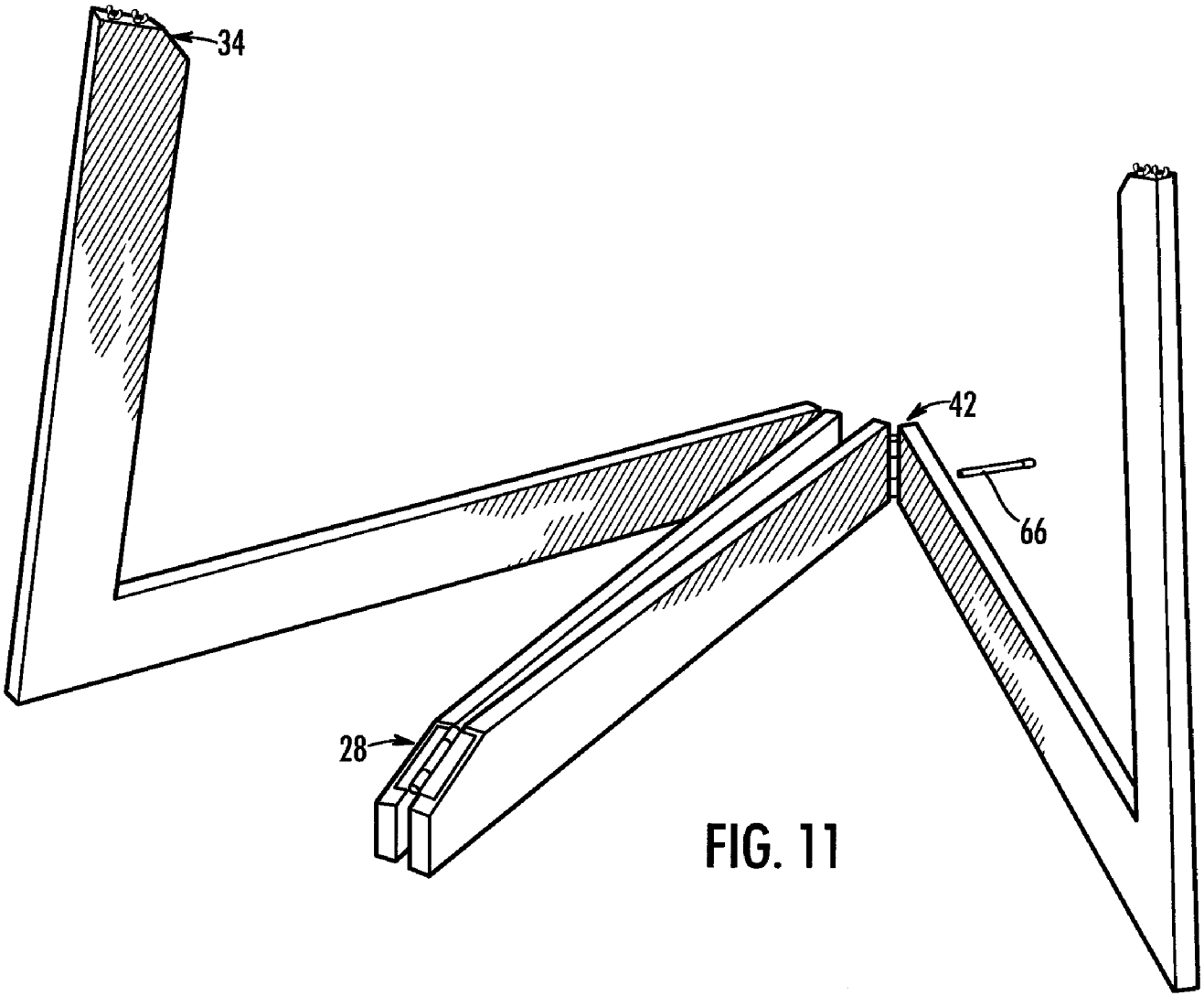
FIG. 11 is an upper perspective of the easel assembly showing both lower portions of the support members being pivoted along the hinge assembly shown in FIG. 5.
Figure 12:
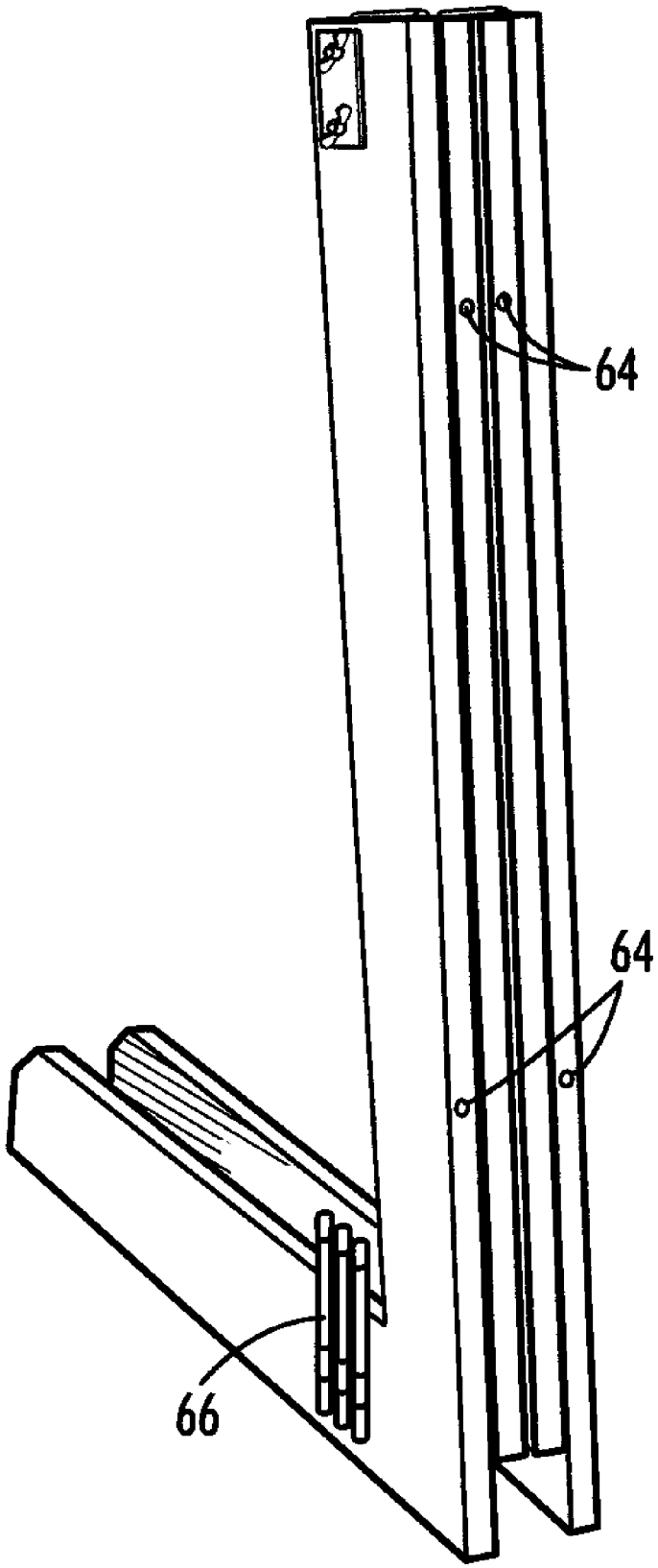
FIG. 12 is a perspective view of the easel assembly in the collapsed position for transport and/or storage.
Figure 13:
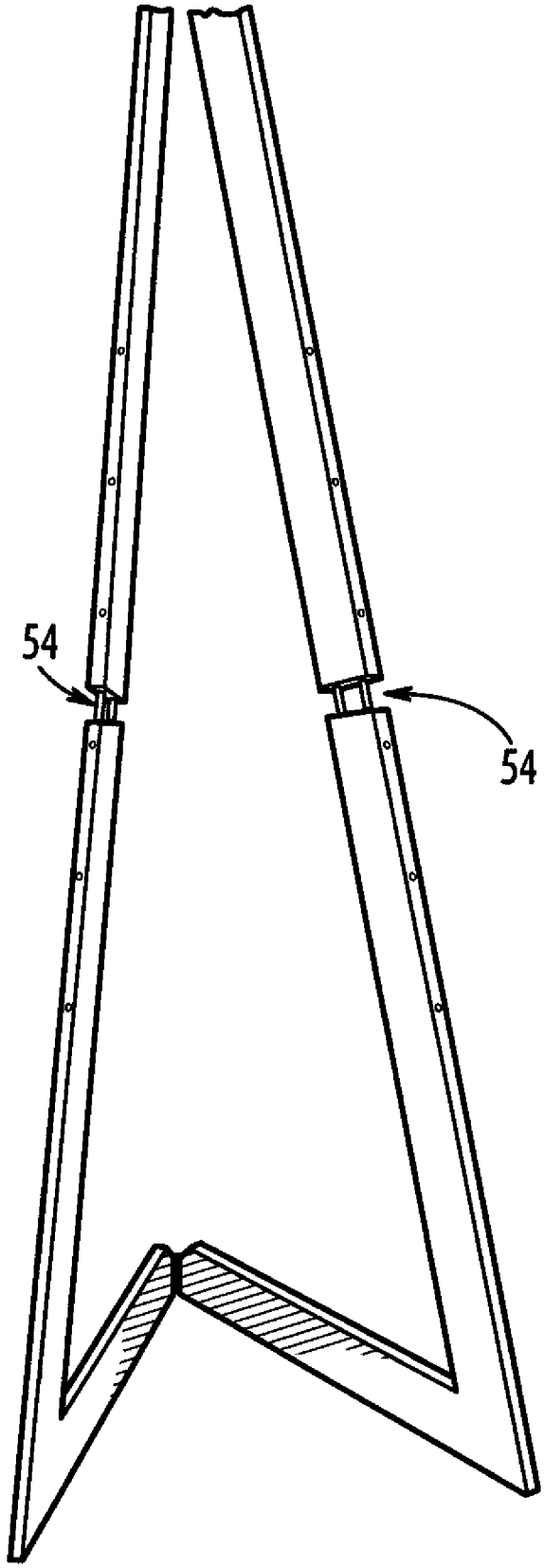
FIG. 13 is an upper perspective view of the easel assembly according to another embodiment of the present invention, as seen from the front in the upright, deployed position.

The upper portion and lower portion of each support member are connected together at a joint 48. The support members allow the easel assembly to attain a collapsed state suitable for transport and storage (see FIG. 12). For example, according to a preferred embodiment shown in FIGS. 1-12, both support members are pivotally interconnected by any commercially available hinge assembly 42. Thus, the upper portions are able to fold together about the hinge 28. When the base members are disconnected and placed on the planar surface, the lower portions of the support members are able to be pivoted about the hinge 42 and juxtaposed to the folded upper portions, thereby reducing the overall size of the easel assembly for easy storage and travel, as shown in FIGS. 10 and 11. According to this illustrative, albeit non-limiting embodiment, the hinge assembly 42 is attached to the support members by threaded posts 52 and wing nuts discussed further below.

Referring to FIGS. 1-12, it is contemplated that the upper and lower portions may also include support plates 44 for enhanced stability of the easel assembly by preventing the hinge assembly 42 from pivoting until desired; however, these support plates are not required. In use, the support plates are positioned on the side opposite that of the hinge assembly 42. Each support plate is constructed and arranged to swivel between a position that spans the joint of the upper and lower support members to prevent pivoting thereabout (see left side of FIG. 6) and a position that will allow the hinge assembly to pivot along the joint (see right side of FIG. 6). According to a preferred embodiment shown in the FIGS. 1-12, the support plates also include at least two apertures 49 and a securing means 50 that engage the upper and lower support members. The securing means are shown here as, albeit non limited to, wing nuts. The posts 52 may also be used to secure the hinge assembly 42 to the upper and lower support members, and are received in the apertures and the securing means is hand tightened in place. Other means of securing could be used without departing from the spirit and scope of the invention.

Figure 14:
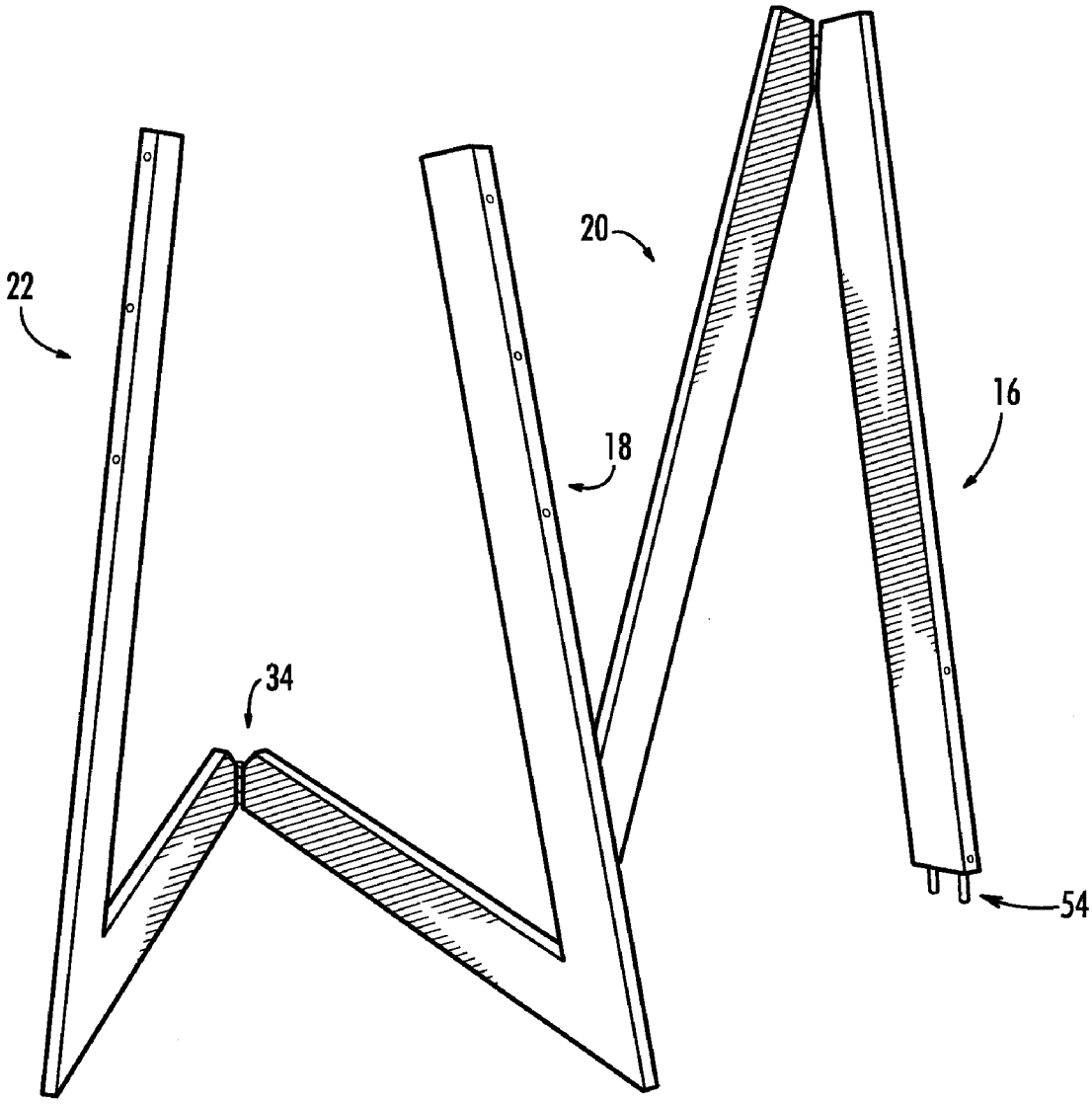
FIG. 14 is an upper perspective view of the easel assembly of FIG. 13 with the upper and lower portion of the support members detached.
Figure 15:
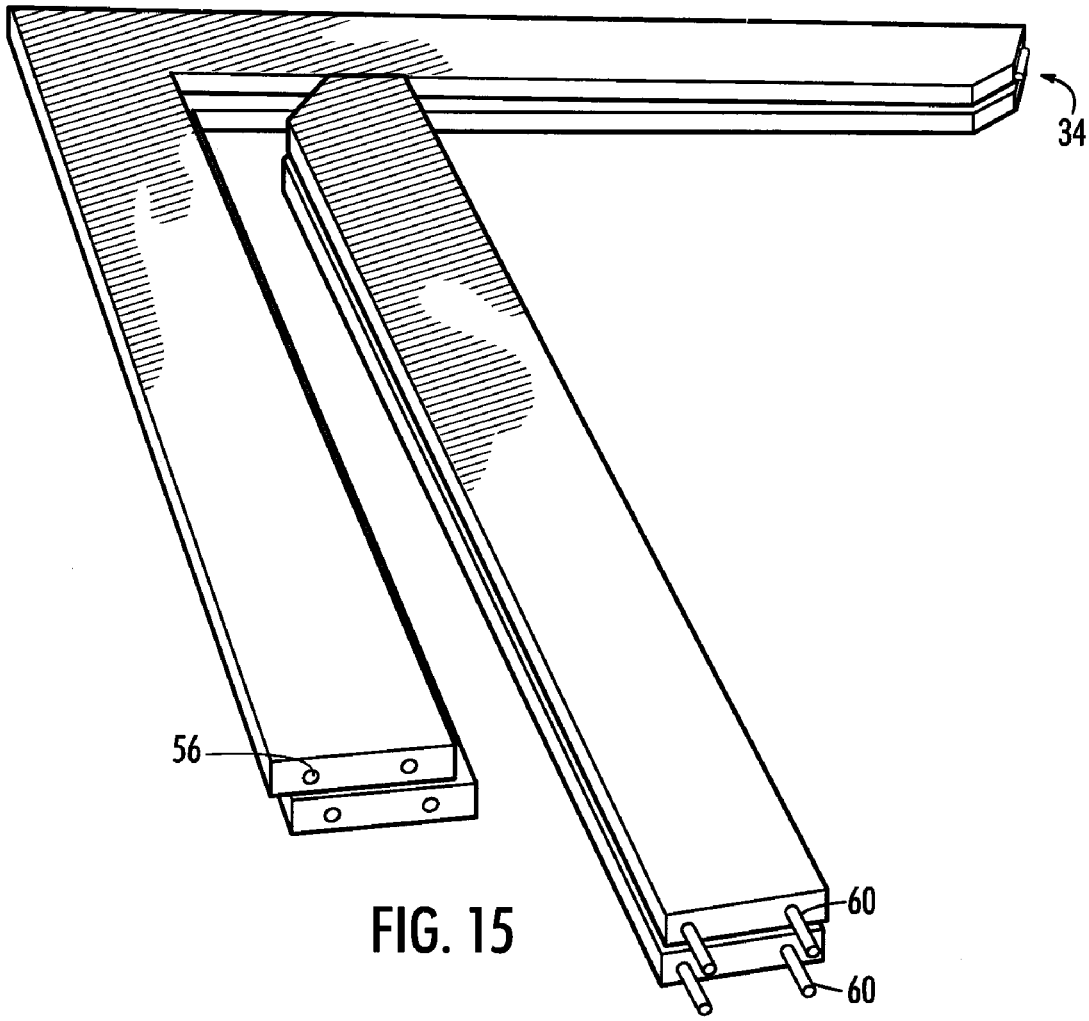
FIG. 15 is an upper perspective view of the easel assembly of FIG. 13 in the collapsed position for transport and/or storage.

Referring now to an alternative embodiment shown in FIGS. 13-16, the upper portion and lower portion of each support member are removably interconnected at joint 48. According to this illustrative, albeit non-limiting example, the upper and lower portion of the support members are removably connected by at least one dowel or rod (two dowels are shown in FIG. 14). That is, one end 60 of the dowel is integrally connected to the upper support member, along its longitudinal axis. Similarly, the other end 62 is constructed and arranged for receipt within corresponding apertures 56 formed inside the lower support member, along its longitudinal axis. Thus, according to this embodiment the base members do not need to be disconnected at the hinge assembly 34 and placed on a planar surface for the separation of the upper and lower portions of the support members. As with the previous embodiment, the separated easel assembly is reduced in overall size for easy storage and transport.

Any of the aforementioned embodiments may include a plurality of apertures 64 formed along both support members 12, 14 at corresponding heights. These apertures are constructed and arranged to receive support dowels 66 designed to hold the weight of a planar item thereon for display. The planar items rest against the support members as shown in FIG. 3. The dowels may be removed from the apertures when the easel is dissembled for easier transport. According to a preferred embodiment, at least one of the support members or base members may include integrally connected holding means 68 constructed and arrange to hold the dowels thereto when removed from the support member so that they do not project outward therefrom. This also ensures the dowels do not become lost when stored and/or catch on items during transport. For example, as shown in FIG. 1, the housing member is a plurality of outward projecting loops or tabs 70 constructed and arranged to hold the dowels during transport and storage.

The upper and lower member of any of the aforementioned embodiments may also include at least one corresponding attachment means capable of holding the upper and lower members together during transport and storage. In an illustrative, albeit non-limiting example as shown in FIG. 2, the upper member and lower member may include hook and loop attachment means (VELCRO™) 72, 74, respectively. In addition, the upper and lower members may include apertures through which the user can insert one of the dowels 66. As shown in FIG. 1, these apertures 78 are formed equidistant from the joint 48, so that when the upper and lower members are placed together, these apertures align so that the user may insert one of the dowels 66 therethrough (see FIG. 11). This also acts to hold the upper and lower member together for easier transport.

Any of the aforementioned embodiments may also include a handle 76 formed thereon which allows the user to hold the easel assembly during transport. The handle may be removably attached to the support member (e.g., snaps) or it may be permanently attached thereto. As shown in the embodiment in FIGS. 1-12, the handle formed is from a durable cloth material for gripping comfort, however, the handle may be formed from any material desired without departing from the scope of the invention, (e.g. plastic, metal, wood, etc.)

The support and base members may be integrally formed or removably attached by any means of attachment known in the art. Moreover, these members may be formed from any durable material deemed suitable for displaying at least one planar item thereon. Suitable materials may include metal, plastic, wood, or the like, either singly or in any combinations thereof.

The method of assembling the easel in accordance with the embodiment shown in FIGS. 1-12 is as follows; first, the easel assembly in the collapsed state (FIG. 12) is placed on a planar surface (e.g., floor, table, etc). The dowel used as an attachment means is then removed from apertures 78. The lower portions of the support member are moved to an extended position along the hinge assembly 42, one support member shown in extended position in FIG. 10. If present, the support plates are pivoted and tightened in place across the joint for enhanced support (see FIG. 9). The base members are then joined together at the side opposite 30, 32 that of the support members by detachable hinge 34, for example, by threading wing nuts 36 over threaded posts 82. The easel assembly may then be placed upright with the base members and support members separated to a deployed position (FIG. 1). The support members are articulated about hinge 28 to an angle 80 that permits the easel to stand upright. The angle is dependent on the upright height of the easel assembly. Finally, a pair of dowels is inserted into the apertures 64 that most closely correspond to the desired height the user wishes the bottom of the planar item to rest against. Of course, the planar item must be placed onto support dowels where the planar item is capable of spanning both support members. Moreover, multiple pairs of dowels may be inserted into the support members depending on the number of planar items to be displayed. In order to disassemble the easel, the procedure is merely reversed.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An easel assembly reversibly transformable between an upright deployed position suitable for supporting at least one planar item thereon and a collapsed position suitable for transport and storage, said easel assembly comprising:

a pair of support members, each having an upper portion and a lower portion, each support member pivotally interconnected at said upper portion for selective movement between a folded position where said support members are generally parallel and a deployed position where said support members divaricate a distance effective to provide stability to the assembly, said lower portion of each of said support members being integrally connected to a base member;

each said base member having a first end and a second end, each said first end of said base member being integrally connected to said lower portion of each said support member, said lower portion of each said support member and each said base member being integrally connected together to form an acute angle therebetween, each said second end of said base member being pivotally interconnected to each said other second end of said base member, said connected base members being positioned on a planar surface when said easel is in said upright deployed position, thereby distributing any downward load of said easel assembly along said planar surface to resist tipping and maintain stability of said deployed easel; and said upper portion and said lower portion of each said support member being interconnected in a manner effective to permit said easel to attain a collapsed state suitable for transport and storage.

2. The easel assembly of claim 1, wherein said upper and lower portion of each said support members are pivotally interconnected by a hinge assembly.

3. The easel assembly of claim 1, wherein said upper and lower portion of each said support members are removably connected by a dowel assembly.

4. The easel assembly of claim 1, wherein at least one of said support members includes a handle suitable for facilitating transport of said easel in its collapsed state.

5. The easel assembly of claim 1, wherein each of said support members include movable brace members constructed and arranged to hold at least one planar item, which item is capable of spanning both support members at a selected height.

* * * * *